US007351158B1

(12) United States Patent
Bronsveld

(10) Patent No.: US 7,351,158 B1
(45) Date of Patent: Apr. 1, 2008

(54) GOLF CLUB WITH DIVOT REPAIR TOOL

(76) Inventor: Ernest B. Bronsveld, 134 Progress Dr., Doylestown, PA (US) 18901

( * ) Notice: Subject to any disclaimer, the term of this patent is extended or adjusted under 35 U.S.C. 154(b) by 0 days.

(21) Appl. No.: 11/671,163

(22) Filed: Feb. 5, 2007

(51) Int. Cl.
*A63B 53/00* (2006.01)

(52) U.S. Cl. ..... 473/286; 172/372; 172/378

(58) Field of Classification Search ..... 473/282; 172/372, 376; 403/109.1, 109
See application file for complete search history.

(56) References Cited

U.S. PATENT DOCUMENTS 4,862,970 A 9/1989 Hlavacek
5,377,977 A 1/1995 MacNeary
5,511,785 A 4/1996 Rusin, Jr.
6,502,646 B2 1/2003 Wiens

*Primary Examiner*—Stephen Blau

(57) ABSTRACT

A divot repair tool comprises a cylindrical housing having at least one helical groove located on the inside wall of an axial bore of the housing. The blade is stored within the axial bore of the housing by mechanical cooperation with the grooves such that the blade projects and retracts from the housing as it is turned. The divot repair tool is preferably rigidly affixed within a golf club shaft at the handle end and the blade is rotated by a knob which includes a slot through which the blade extends and retracts.

14 Claims, 2 Drawing Sheets

GOLF CLUB WITH DIVOT REPAIR TOOL

FIELD OF THE INVENTION

The present invention relates to accessories affixed to golf clubs and more specifically to a divot repair tool that is held within the shaft of the golf club at the grip end. It further relates to divot repair tools in the end of golf putters which are extendable from inside the club, however it could be used in other clubs around the putting green such as wedges and other utility clubs.

BACKGROUND OF THE INVENTION

Maintaining the condition of a golf course is of prime concern, especially with the increased amount of play due to the growing popularity of the sport. One of the most important areas of the golf course is the putting green which must be maintained in near perfect condition so that the golf ball rolls true along the putting surface. Unfortunately the putting green is often damaged by foot traffic across the green and ball impact damage. Damaged areas of the golf course playing surface caused by such use are commonly called divots or ball marks. In order to maintain the condition of the course, players are urged to repair all divots that they notice or create during a round of play. Particular attention is urged with regard to the putting surface of the greens due to the sensitive nature of their effect upon a player's score. An immediate repair facilitates the natural recovery of the grass system which would otherwise dry out, preventing the grass root system from re-growing.

In order to facilitate the repair of putting green divots, various tools have been devised for golfers to carry and use. Divot repair tools are typically fork-shaped implements having tines that are pressed into the playing surface which can then be lifted or otherwise manipulated to restore its condition. Some divot repair tools are incorporated into the end of the handle or grip end of the golf putter. Examples are shown in various prior art patents such as U.S. Pat. No. 4,862,970 issued to Hlavacek; U.S. Pat. No. 5,511,785 issued to Rusin, Jr.; U.S. Pat. No. 5,377,977 issued to MacNeary; and U.S. Pat. No. 6,502,646 issued to Wiens. Each of these patents discloses a divot repair tool which is extendable from and retractable back into the golf putter shaft, each having a different mechanical mechanism for controlling the movement and positioning of the divot repair tool. However, in each of these cases, there are limitations. For example, in some cases the golf putter shaft needs to be greatly modified. In other cases, the repair tool is not easily actuated or held in its locked operative position. For example, in the case of U.S. Pat. No. 4,862,970 issued to Hlavacek, the divot repair tool always remains protruding from the top of the handle and the tines must be manually pulled out of the top by fingernail grooves. This is particularly inconvenient in that grasping the tines is difficult and by the nature of their use the tines are most often covered with dirt. This makes use of this particular device inconvenient and unsanitary.

There is therefore a need in the art for an improved, retractable golf putter divot repair tool which does not detract from the aesthetic appearance of the golf putter, is easy to use, is safe and sanitary, is easily retrofittable to a golf putter without any major modification, and which is economical to manufacture.

SUMMARY OF THE INVENTION

In order to meet the needs in the art described above, the present retractable divot repair tool has been devised. The repair tool comprises a cylindrical housing having at least one helical groove located on an inside wall thereof. A blade is stored within a central axis bore of the housing with a body portion and at least one ground-engaging prong at the working end with means for engaging the at least one groove of the housing projecting from the body of the blade. Blade rotating means are rotatably affixed to a top end of the housing, the blade being slidable through an aperture in the rotating means. The means for engaging the at least one helical groove of the housing is operative whereby turning the blade rotating means with respect to the housing causes the blade to extend or retract within the housing depending on the direction of rotation of the blade rotating means.

The repair tool is preferably rigidly affixed within the golf club shaft at a handle end and the blade rotating means is preferably a cylindrical knob having surface features along an outside wall thereof to facilitate grasping. The knob includes a substantially rectangular slot which closely receives the passage of the blade as it moves between extended and retracted positions. The blade can be substantially planar and elongate further including a pair of ground-engaging prongs that extend from the working end. The means for engaging the at least one helical groove of the housing can be lugs extending from opposite lateral sides of the blade. The pitch of the at least one helical groove is such that by engagement with the blade lugs the blade is held against axial movement with respect to the housing at all points of blade extension. The housing is preferably constructed with two parallel helical grooves engaged by two lugs on the blade, one extending from each of opposite lateral sides of the blade and each lug occupying a different one of the two helical grooves. In order to provide evenly distributed forces to the blade, the lugs are located directly opposite each other. In its fully retracted position the working end of the blade lies at or below a top surface of the knob.

As explained above, there are benefits from the invention to enhancing the condition of the putting green. Also, speed of play is maintained as this tool is immediately available and divot repairs are done more quickly. Finally, comfort is promoted because the length of the club allows the divot repair tool to be used from a standing position and therefore the user is not required to kneel or squat.

It is therefore the main object of the invention to provide a retractable golf club divot repair tool of improved performance which does not retract from the aesthetic appearance of the golf club. It is a further object of the invention to provide a retractable golf putter divot repair tool which is easy to use, safe, and sanitary. It is yet a further object of the invention to provide a golf putter divot repair tool which is easily retrofittable to a golf putter without major modification. It is yet another object of the invention to provide a retractable golf putter divot repair tool which is economical to manufacture.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designating of other structures, methods, and systems for carrying out the several purposes of the present invention. It is important, therefore, that the claims be regarded as including such equivalent constructions insofar as they do not depart from the spirit and scope of the present invention.

DESCRIPTION OF THE PREFERRED EMBODIMENT

Figure 1:
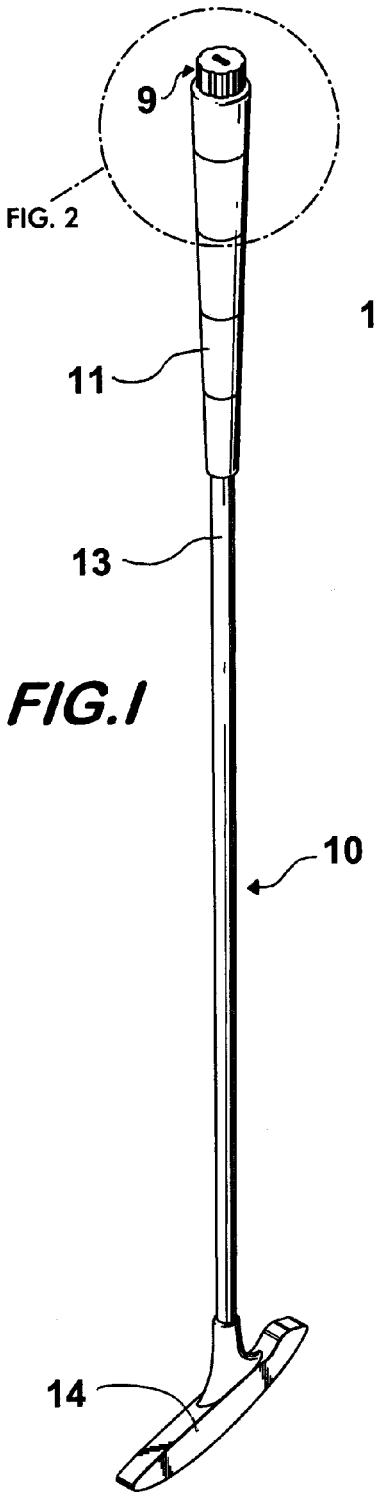
FIG. 1 is a top right front isometric view of the invention installed in the end of a golf putter.
Figure 2:
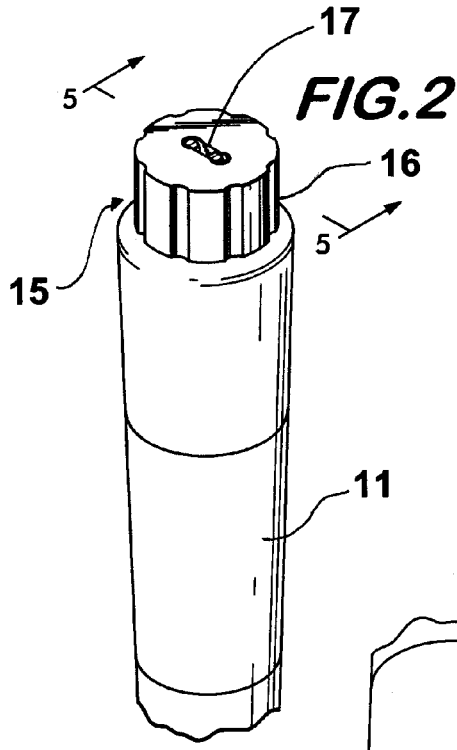
FIG. 2 is an enlarged view of a portion of FIG. 1 taken from that figure as shown therein.

Referring now to FIG. 1, the present invention 9 is shown installed in the handle end of golf putter 10. The golf putter is of conventional design which includes a shaft 13 with a ball striking head 14 at one end and a hand grip 11 at the opposite end. Referring now to FIG. 2, the invention is more closely shown extending from the top of the golf shaft grip 11. As will be described below in greater detail, the invention includes a knob 15 that has a blade slot 17 through which the tool extends. The outer surface of the knob 15 is preferably textured to facilitate grasping and includes in this embodiment flutes 16 to accomplish that purpose. As seen in FIGS. 1 and 2 the divot repair tool is not visible when fully retracted, lying below or flush with a top surface of the knob. Thus, the appearance of the advance/retract mechanism is minimal, providing a neat and pleasing appearance.

Figure 3:
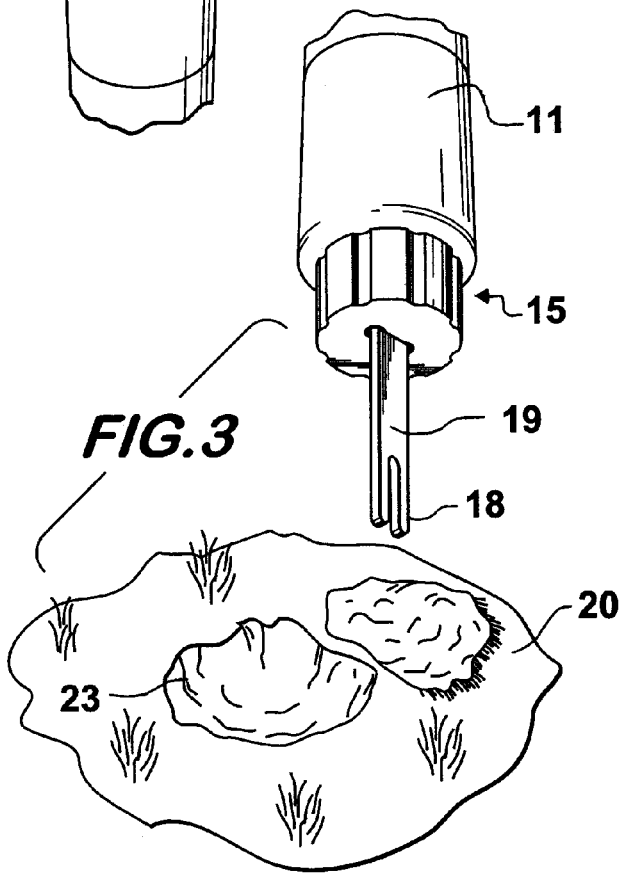
FIG. 3 is a top right front isometric view of the invention in use.

Referring now to FIG. 3, the invention is shown in its intended use with repair tool blade 19 extending through the slot of knob 15. In use, the golf putter is inverted such that the grip portion 11 is at the bottom facing the ground 20, the putter being held by the user at the club head end. Prongs 18 extending from the end of blade 19 are used to penetrate the soil 20 to repair the divots or ball marks 23.

Figure 4:
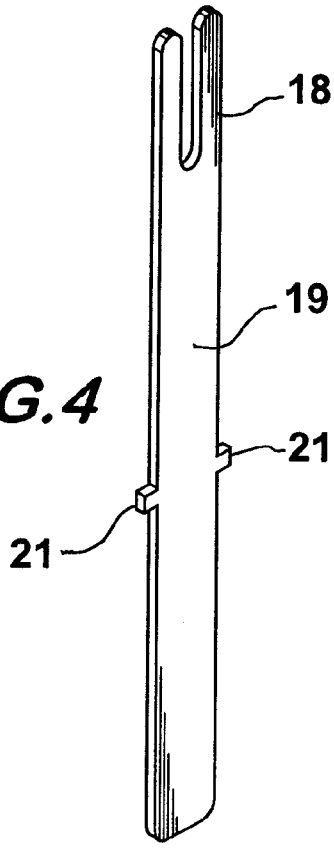
FIG. 4 is a top right isometric view of the blade component of the invention.
Figure 5:
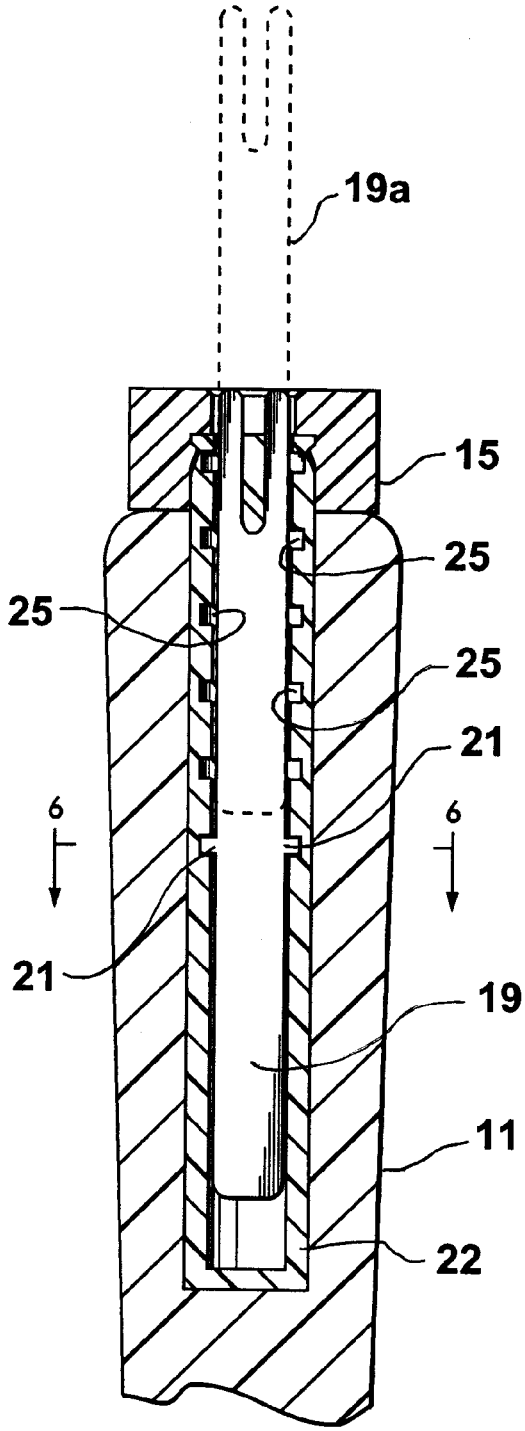
FIG. 5 is a lateral cross-section view taken from FIG. 2 as shown in that figure.

Referring now to FIG. 4, the blade component of the invention is shown in isolation. The blade includes a main body portion 19 with the ground-engaging prongs 18 extending from the end thereof. Lugs 21 extend outwardly from the lateral sides of the blade. These lugs engage other components of the invention to cause the movement of the blade as illustrated in FIG. 5. The lugs are directly opposite each other to balance the actuation forces on the blade.

Figure 6:
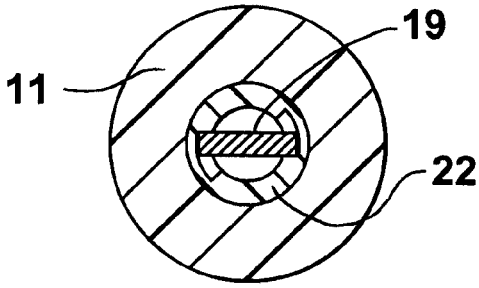
FIG. 6 is a top plan sectional view taken from FIG. 5 as shown in that figure.

As shown in FIG. 5, the blade 19 is axially extendable from a fully retracted position within the golf club handle 11 to a fully extended position 19*a* shown in phantom in this figure. Movement of the blade from retracted to extended positions or any intermediate position therebetween is caused by turning knob 15. Knob 15 is rotatably affixed to housing 22 which in turn is rigidly fitted within the gold club shaft. The housing includes a pair of helical grooves 25 which are engaged with blade lugs 21. This is also shown in FIG. 6 which depicts the blade 19 and lugs engaged with the grooves of housing 22 affixed within handle 11.

It will be appreciated by those of skill in the mechanical arts that owing to these mechanical relations the rotation of knob 15 will in turn cause the rotation of blade 19 that is slidably engaged within the slot of the knob. This causes the lugs 21 to be forced upwardly by the grooves of the housing, thus pushing the blade up through the slot in the knob in corkscrew fashion. It will also be understood that by turning the knob to a greater or lesser extent, the degree of extension of the blade from the knob can be regulated and, as shown in FIG. 5, the blade may be fully retracted below a point flush with the top surface of the knob so that it is not visible. In addition, the helical housing grooves are of such a pitch that the blade is secured against axial movement at all points of extension. The tool can thus be selectably used at intermediate positions of extension from the top of the handle. This is a key advantage of the present invention over the prior art which in most cases provides only two positions of the divot tool, fully extended and fully retracted.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A retractable golf club mounted divot repair tool, comprising:

a cylindrical housing having at least one helical groove located on an inside wall thereof;

a blade being axially reciprocal within a bore of the housing, said blade including a body portion and at least one ground-engaging prong at a working end thereof;

means for engaging said at least one groove of said housing projecting from said body of said blade;

blade rotating means rotatably affixed to a top end of said housing, said blade being slidable through an aperture in said rotating means; and said means for engaging the at least one helical groove of said housing being operative whereby turning the blade rotating means with respect to said housing causes the blade to extend or retract within said housing depending on the direction of rotation of said blade rotating means.

2. The golf club repair tool of claim 1 further including a golf club having a shaft and a handle end within which said housing is rigidly affixed.

3. The gold club and repair tool of claim 2 wherein said blade rotating means is a cylindrical knob having surface features along an outside wall thereof to facilitate grasping.

4. The golf club and repair tool of claim 3 wherein said knob includes a substantially rectangular slot which closely receives the passage of said blade as it moves between extended and retracted positions.

5. The gold club and repair tool of claim 4 wherein said blade is substantially planar and elongate.

6. The golf club and repair tool of claim 5 wherein the blade includes a pair of ground-engaging prongs extending from the working end.

7. The golf club and repair tool of claim 2 wherein said golf club is a putter.

8. The golf club and repair tool of claim 1 wherein said means for engaging the at least one helical groove of said housing are lugs extending from opposite lateral sides of the blade.

9. The gold club and repair tool of claim 8 wherein the pitch of said at least one helical groove is such that by engagement with said blade lugs the blade is held against axial movement at selective operative points of blade extension with respect to said housing.

10. The golf club and repair tool of claim 8 wherein said lugs are only two lugs.

11. The golf club and repair tool of claim 10 wherein said lugs are located directly opposite each other.

12. The golf club and repair tool of claim 1 wherein said at least one helical groove are two parallel helical grooves.

13. The golf club and repair tool of claim 12 wherein said means for engaging the two helical grooves of said housing are two lugs, one extending from each of opposite lateral sides of said blade, each lug occupying a different one of said two helical grooves.

14. The golf club and repair tool of claim 1 further described in that said blade has a fully retracted position where the working end lies at or below a top surface of said blade rotating means.

* * * * *